US006044654A

United States Patent [19]

Igari et al.

[11] Patent Number: 6,044,654

[45] Date of Patent: Apr. 4, 2000

[54] REFRIGERATOR

[75] Inventors: Keiko Igari; Mutsumi Kato; Katsumasa Sakamoto; Kouichi Hashimoto; Takenori Adachi, all of Tokyo, Japan

[73] Assignee: Mitsubishi Denki Kabushiki Kaisha, Tokyo, Japan

[21] Appl. No.: 09/063,392

[22] Filed: Apr. 21, 1998

[30] Foreign Application Priority Data

Apr. 25, 1997 [JP] Japan ..... 9-109177
Jan. 23, 1998 [JP] Japan ..... 10-010956

[51] Int. Cl.[7] ..... F25D 17/04

[52] U.S. Cl. ..... 62/186; 62/131; 62/408; 236/49.3

[58] Field of Search ..... 62/186, 408, 89, 62/131; 236/51, 49.3

[56] References Cited

U.S. PATENT DOCUMENTS 5,678,413 10/1997 Jeong et al. ..... 62/89
5,778,688 7/1998 Park et al. ..... 62/89
5,778,694 7/1998 Jeong ..... 62/187
5,799,496 9/1998 Park et al. ..... 62/89
5,799,500 9/1998 Kang ..... 62/408
5,802,867 9/1998 Kang ..... 62/408
5,822,998 10/1998 Lim et al. ..... 62/186

FOREIGN PATENT DOCUMENTS 1-300180 12/1989 Japan .
4-148178 5/1992 Japan .
6-3027 1/1994 Japan .
84112707 8/1998 Taiwan .

*Primary Examiner*—Henry Bennett
*Assistant Examiner*—Marc Norman
*Attorney, Agent, or Firm*—Oblon, Spivak, McClelland, Maier & Neustadt, P.C.

[57] ABSTRACT

To provide a refrigerator capable of uniforming the temperature in the refrigerator by rapidly lowering the temperature at the door side of the refrigerator when the temperature rises by opening and closing a refrigerator door. Therefore, a cold air channel 18 is provided for the side of a refrigerator 6 separately from a cold air channel 11 at the back of the refrigerator 6 to control the amount of cold air supplied from side cold-air blowoff ports 23 by a side temperature sensor 20 and a side temperature damper 19.

16 Claims, 15 Drawing Sheets

PRIOR ART

PRIOR ART

PRIOR ART

REFRIGERATOR

BACKGROUND OF THE INVENTION

The present invention relates to the air channel structure and cold air control of a refrigerator for improving a temperature distribution in a refrigerating chamber.

FIGS. 13 and 15 are sectional views showing a conventional refrigerator as shown in the official gazette of Japanese Patent Laid-Open No. 8-75338. In FIGS. 13 and 15, symbol 1 denotes a refrigerator door, 2 an outer case of the refrigerator made of a steel plate, 3 an inner case formed through vacuum molding of a synthetic resin sheet, 4 a heat insulting material made of polyurethane or the like injected between the outer case 2 and the inner case 3, and 5 a heat insulating partition for separating a refrigerating chamber 6 from a freezing chamber 7.

Symbol 8 denotes a cooling unit, 9 a cooler chamber having the cooling unit 8 inside, 10 a cold air suction channel provided in the heat insulating partition 5, 11 a back cold-air channel for supplying cold air to the refrigerating chamber 6 from the cooler chamber 9, 12 a back damper for controlling the amount of cold air to supply to the back cold-air channel 11, and 13 a back temperature sensor for controlling the operation of the back damper 12 by detecting the air temperature of the back portion in the refrigerator.

Symbol 14 denotes a back blowoff port formed on the back cold-air channel 11 and 15 a refrigerator fan motor set in the cooler chamber 9 for supplying cold air to the back cold-air channel 11.

Symbol 16 denotes a shelf for placing food and the like and back blowoff ports 14 are provided for every compartment partitioned by the shelf 16.

Symbol 17 denotes a shelf supporting rail for mounting the shelf 16, which is integrally formed in the depth direction to the both sides of the inner case 3.

FIG. 14 is a flow chart showing the procedure for controlling the temperature of the refrigerating chamber. When the program starts, a back detected temperature A detected by the back temperature sensor 13 is inputted in step 101 and a back set temperature B of the refrigerating chamber is inputted in step 102 to compare it with the inputted back detected temperature in step 103. When the back detected temperature A is equal to or higher than the back set temperature B, the program goes to step 104 where the back damper 12 is opened to introduce cold air into the refrigerating chamber 6 and returns to step 101. When the back detected temperature A is lower than the back set temperature B, the program goes to step 105 where the back damper 12 is closed to prevent cold air from being introduced into the refrigerating chamber 6 and returns to step 101.

As the size of a refrigerator tends to increase, the importance of food temperature control is stressed. Particularly, when the capacity of the refrigerator is large, the temperature distribution in a storing chamber becomes uneven so that more accurate temperature control is requested. However, because of such constitution of a conventional refrigerator as described above, the food put on the front side of a shelf or in a door pocket provided in the refrigerator is not easily cooled so that a storing condition becomes worse though the food put on the inner part of the shelf is completely cooled. Moreover, there is a problem that the temperature of the food put on the front side of the shelf or in the door pocket rises due to the outside air (warm air) entering the refrigerating chamber whenever the door is opened and closed and therefore, the food is not easily cooled even after the door is closed.

SUMMARY OF THE INVENTION

The present invention is made to solve the above problems and its object is to uniform the temperature distribution in a refrigerating chamber.

A refrigerator of the present invention comprises a cold air supply duct for supplying cold air to cold air blowoff ports at the back and side of a refrigerating chamber from a cooler chamber in which cooling unit is set, a damper for opening and closing an intake port of cold air for the cold air supply duct, temperature detection means for detecting the temperature of the refrigerating chamber, and means for controlling the operation of the damper in accordance with the temperature detected by the temperature detection means, wherein at least one of the cold air blowoff ports at the side of the refrigerating chamber is located nearby the door of the refrigerator. Thereby, it is possible to stably cool the food on the front side of a shelf.

Moreover, a refrigerator of the present invention comprises a back cold air supply duct for supplying cold air to cold air blowoff ports at the back of a refrigerating chamber from a cooler chamber in which a cooling unit is set, a side cold-air supply duct for supplying cold air to cold air blowoff ports at the side of the refrigerating chamber, a back damper for opening and closing a back intake port of cold air for the back cold-air supply duct, and a side damper for opening and closing a side intake port of cold air for the side cold-air supply duct. Thereby, it is possible to independently control the amount of cold air to supply to the front in the refrigerator and the amount of cold air to supply to the back in the refrigerator.

Furthermore, a refrigerator of the present invention comprises back temperature detection means for detecting the temperature of the back in a refrigerating chamber, side temperature detection means for detecting the temperature of the side of the refrigerating chamber, and control means for controlling the operation of a damper in accordance with the both or either of the values detected by the detection means. Thereby, it is possible to independently control the amount of cold air to supply to the front in the refrigerator and the amount of cold air to supply to the back in the refrigerator and eliminate the temperature difference in the refrigerating chamber.

Furthermore, a refrigerator of the present invention comprises back temperature detection means for detecting the temperature of the back of a refrigerating chamber, door operation detection means for detecting the opening or closing of the door of the refrigerating chamber, and control means for controlling the operation of dampers in accordance with the both or either of the values detected by the detection means. Thereby, it is possible to independently control the amount of cold air to supply to the front in the refrigerator and the amount of cold air to supply to the back in the refrigerator and eliminate the temperature difference in the refrigerating chamber.

Furthermore, a refrigerator of the present invention is constituted by a cold air supply duct to cold air blowoff ports at the side of a refrigerating chamber, embedded in a heat insulating material. Thereby, it is possible to simplify the refrigerating chamber.

Furthermore, a refrigerator of the present invention is constituted by a cold air supply duct to cold air blowoff ports at the side of a refrigerating chamber, integrally formed to an inner case of the refrigerating chamber. Thereby, it is possible to simplify the structure of the cold air supply duct.

Furthermore, a refrigerator of the present invention is constituted by a side cold-air supply duct formed with both a shelf support rail protruded to the inside of the refrigerating chamber, for mounting a shelf to partition the refrigerating chamber and the inner case of the refrigerating chamber. Thereby, it is possible to simplify the structure of the cold air supply duct.

Furthermore, a refrigerator of the present invention is constituted so as to control the operation of a side damper after opening and closing the door of a refrigerating chamber to control the amount of cold air to a cold air supply duct to the blowoff ports at the side of the refrigerating chamber. Thereby, it is possible to obtain an appropriate amount of cold air corresponding to the temperature of the front in the refrigerator.

Furthermore, a refrigerator of the present invention is constituted so as to control the number of revolutions of a fan motor in the refrigerator in accordance with the both or either of the values detected by side temperature detection means and back temperature detection means. Thereby, it is possible to control an amount of cold air to supply correspondingly to side temperature and back temperature.

Furthermore, a refrigerator of the present invention comprises a cold air communicating duct provided for the ceiling or side of a refrigerating chamber for communicating cold air to the door side of the refrigerating chamber from a back or side cold-air supply duct and a door cold-air supply duct for supplying cold air to cold air blowoff ports of the both or either of the back and side of a door shelf portion provided for a door of the refrigerating-chamber from the cold air communicating duct. Thereby, it is possible to stably cool the food and the like on the door portion of the refrigerating chamber.

DETAILED DESCRIPTION OF THE PREFERRED EMBODIMENTS

Embodiment 1

Figure 1:
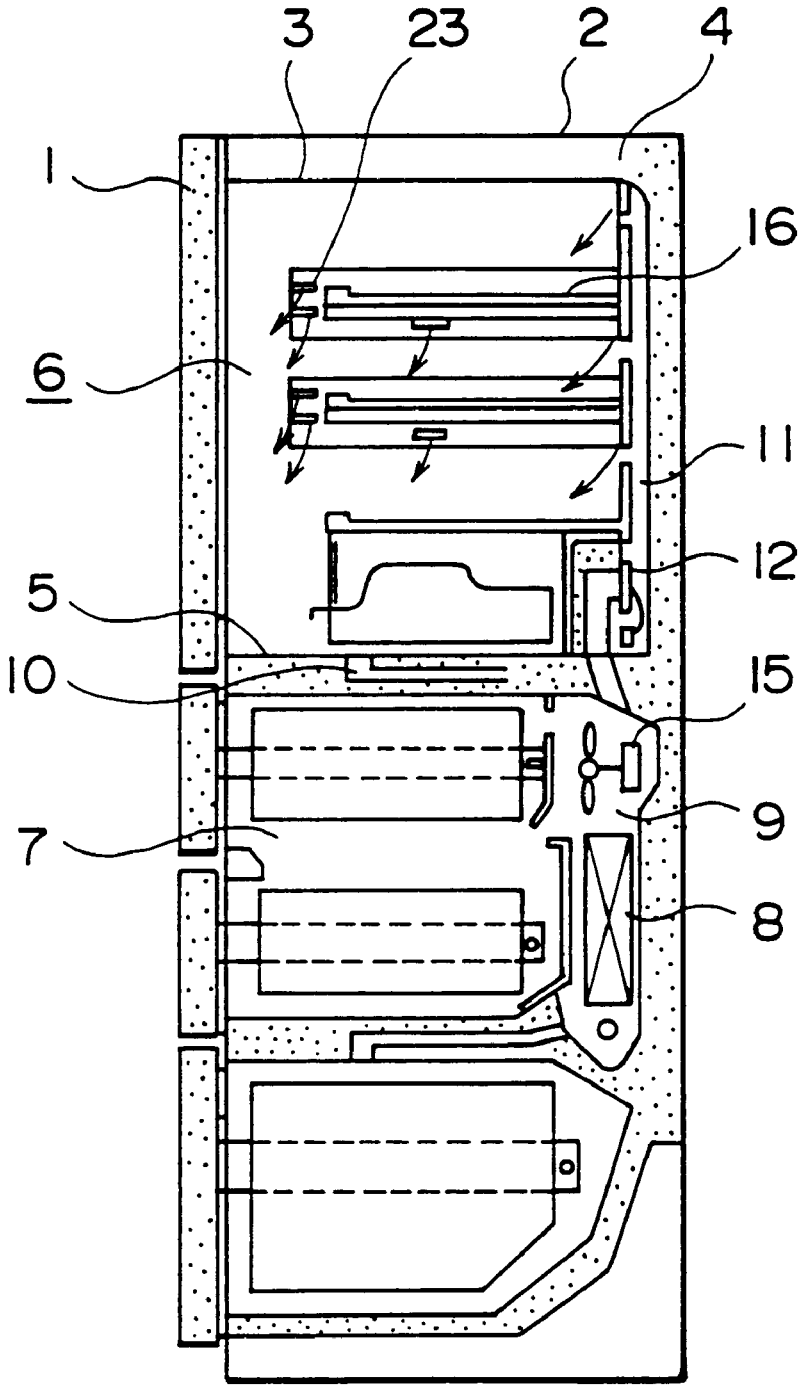
FIG. 1 is a sectional view of the refrigerator of embodiment 1 of the present invention.

The embodiment 1 of the present invention is described below by referring to the accompanying drawings.

In FIGS. 1, 2, 3, 8, 9, 10, 11, and 12, symbols 1 to 16 denote same objects as those previously described and therefore, their description is omitted.

In these drawings, symbol 18 denotes a side cold-air supply duct (side cold-air channel) for supplying cold air to the side in a refrigerating chamber 6 from a cooler chamber 9, 19 denotes a side damper for controlling the amount of cold air to supply to the side cold-air supply duct 18, and 20 denotes a side temperature sensor serving as side temperature detection means provided at the front of the side in a refrigerator, which controls the operation of the side damper 19 by detecting the air temperature at the front in the refrigerator.

The side cold-air supply duct 18 is formed by fixing a shelf support rail 21 for mounting the shelf 16, to a recess 22 integrally formed in the depth direction to refrigerating-chamber inner case 3.

Symbol 23 denotes a side blowoff port provided for the side cold-air supply duct 18, which is located at a portion close to a door pocket 27, the bottom of a protrusion 28 of the shelf support rail 21, and the lower side of the protrusion 28 respectively designated as 23*a*, 23*b* and 23*c*.

Figure 3:
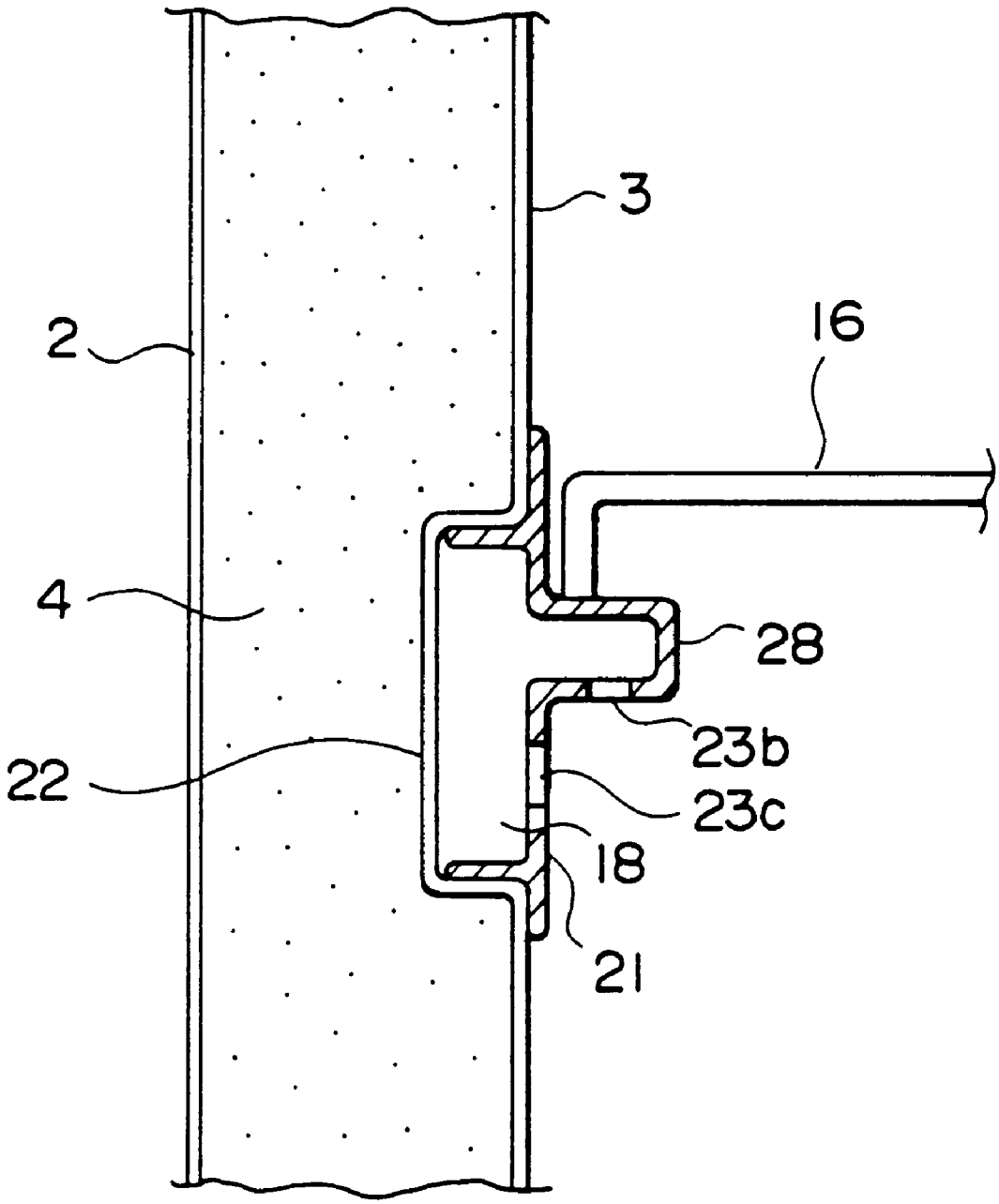
FIG. 3 is a sectional view of an essential portion of the refrigerator of the embodiment 1 of the present invention.
Figure 8:
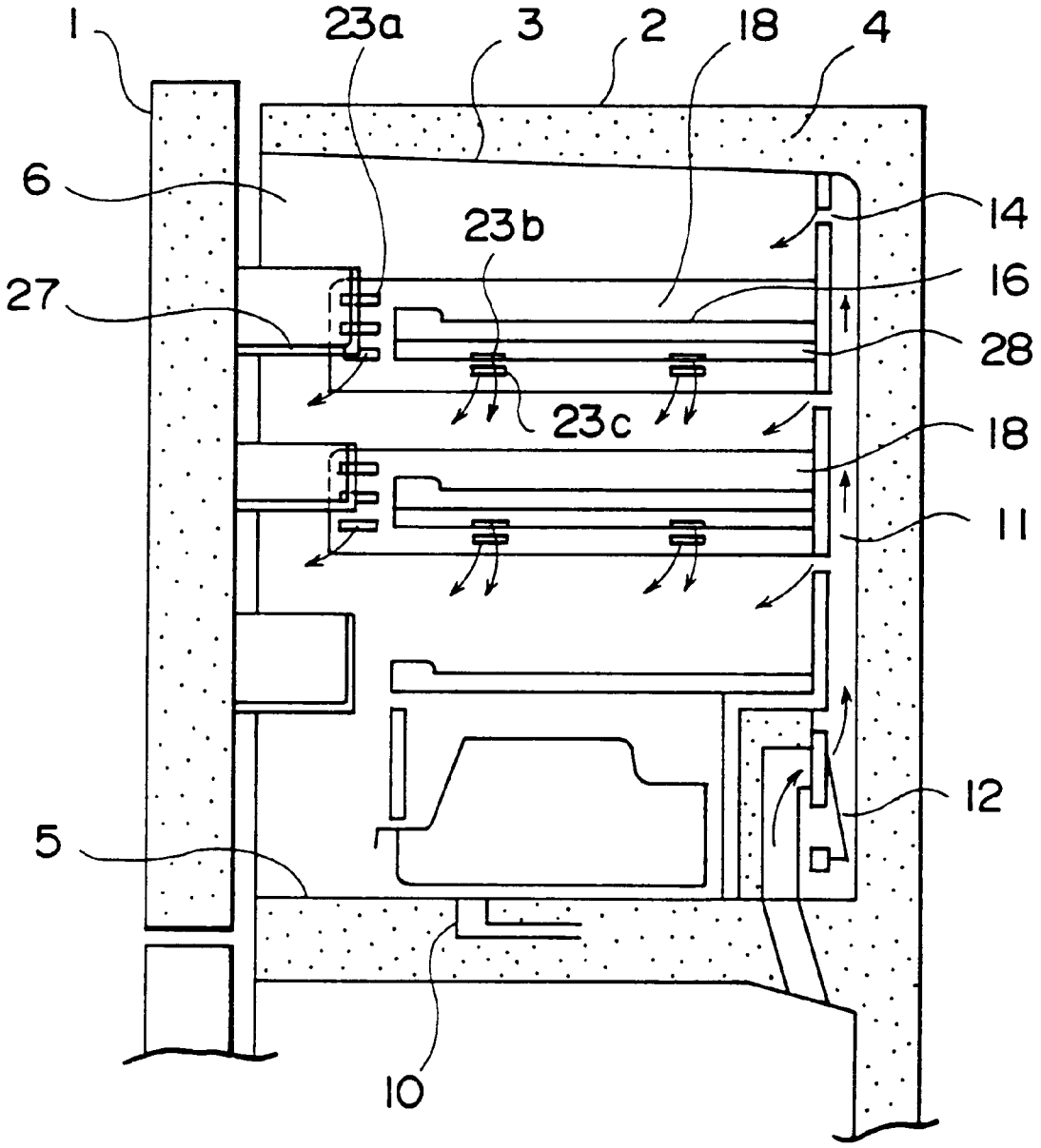
FIG. 8 is an enlarged sectional view of the refrigerator of the embodiment 1 of the present invention.

In FIG. 3, a side cold-air blowoff port 23*c* faces sideward and 23*b* faces downward. Therefore, a sufficient amount of cold air can be supplied to spaces between foods. In FIG. 8, a door pocket 27 for supplying a storage space is attached to a door 1 of the refrigerating chamber 6, and a side cold-air blowoff port 23*a* is also provided for a portion close to the door pocket 27. So it is possible to completely cool not only the food put at the door side of a refrigerating chamber, for example, on front side of the shelf 16 to partition the refrigerating chamber but also the food put in the door pocket 27. Even if the width or depth of a refrigerating chamber increases due to increase of the capacity of a refrigerator, it is possible to cool the food on the shelf 16 and the food in the door pocket 27 from the both sides, eliminate the temperature difference between the front side and the inner part in the refrigerating chamber, and uniformly lower the temperature in the refrigerating chamber. Thus, it is possible to rapidly cool the food put on front side of the shelf and in the door pocket even if the temperature of the foods rises because of opening and closing of the door.

Figure 9:
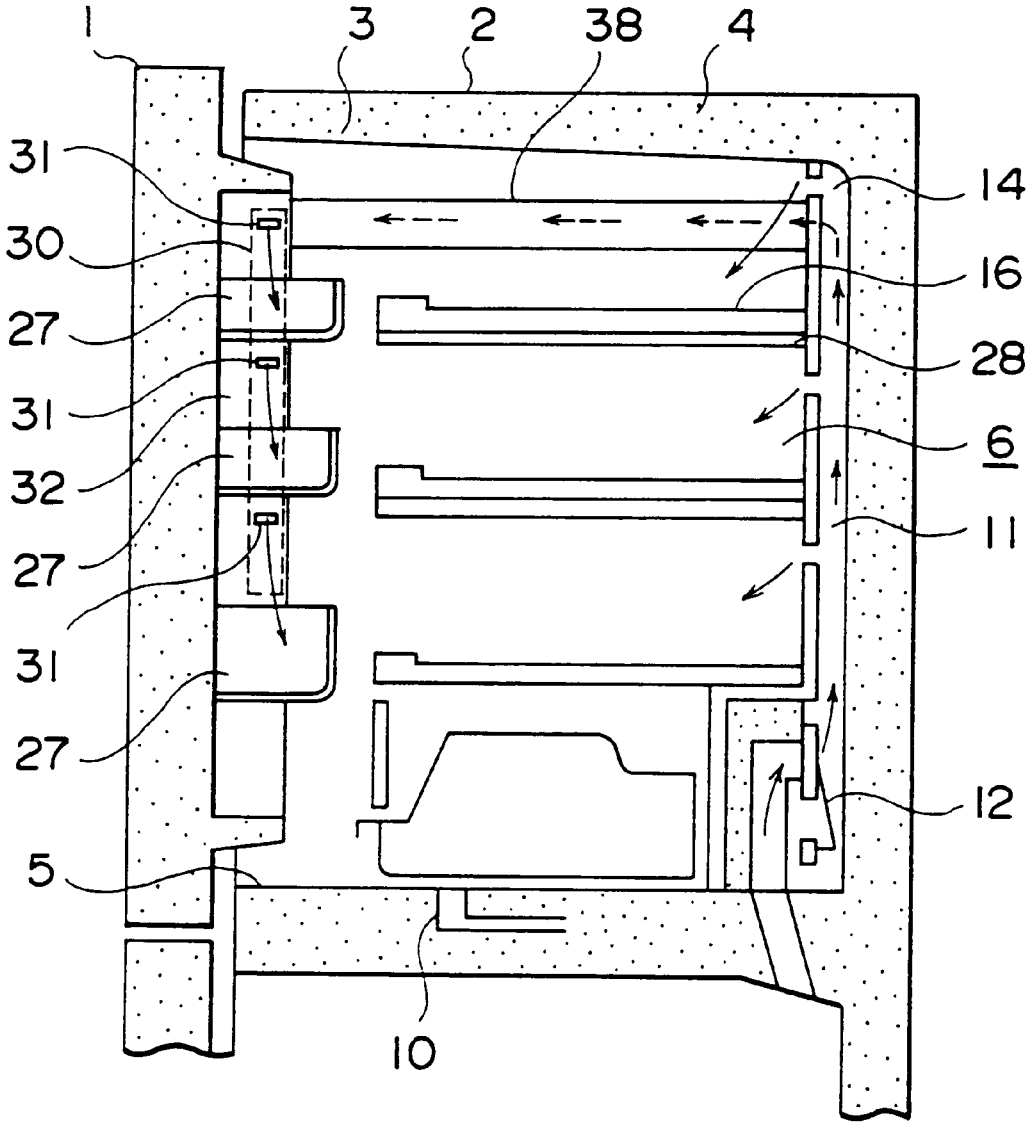
FIG. 9 is an enlarged sectional view of the refrigerator of the embodiment 1 of the present invention.
Figure 10:
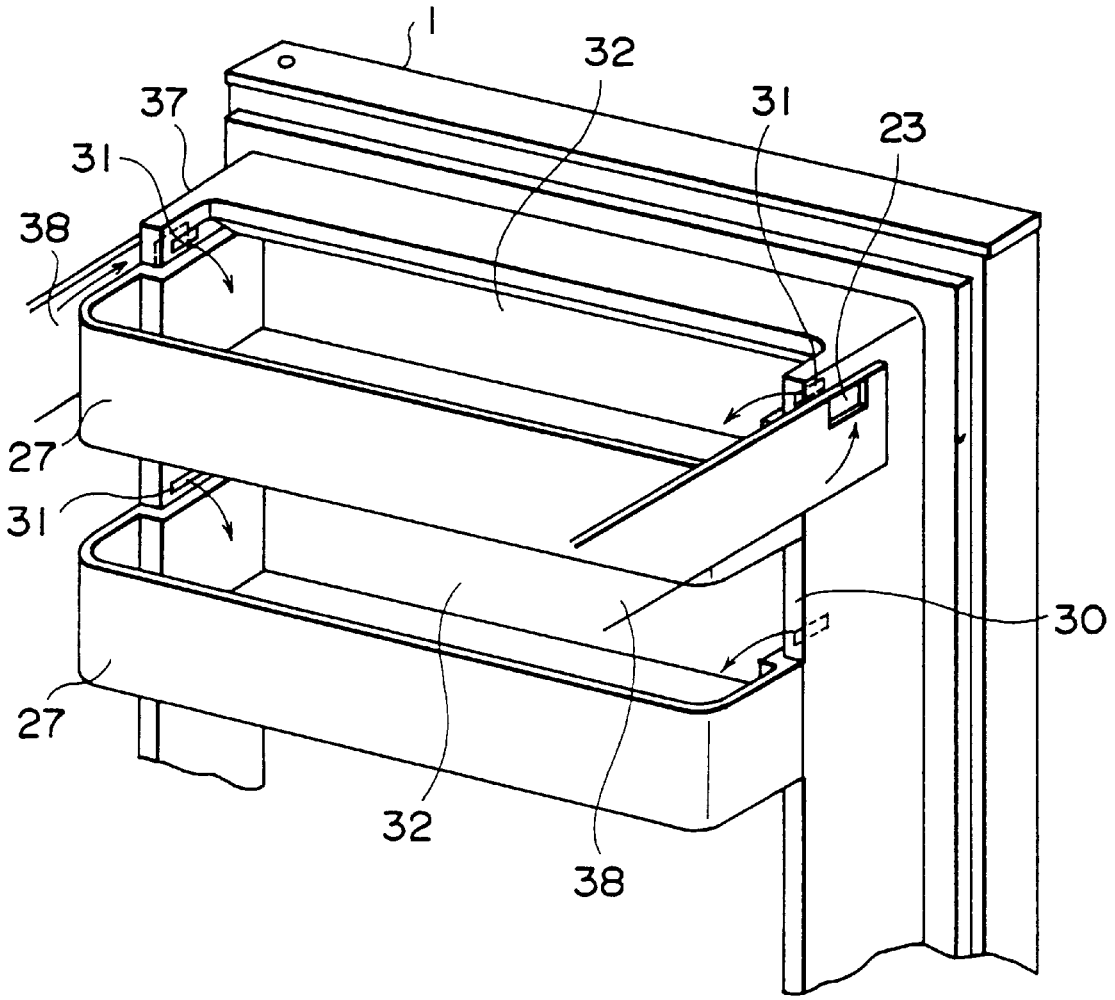
FIG. 10 is a perspective view of the inside of the refrigerator of the embodiment 1 of the present invention.

In FIGS. 9 and 10, some of the cold air in a back cold-air supply duct (back cold-air channel) 11 flows through a side cold-air communicating duct 38 in the direction of the arrow, blows off from the side cold-air blowoff port 23 close to the door pocket 27, and enters a door cold-air supply duct 30 provided for a refrigerator-door inner plate 37. Cold air blows off from a cold air blowoff port 31 provided for the door cold-air supply duct 30 and located at the side of a door shelf portion 32 serving as a storage space of the door pocket 25 to each door shelf portion 32 so as to cool the food and the like in the storage space of the door pocket 27 from the side.

In this case, the cold air blowoff port 23 of the side cold-air communicating duct 38 is arranged oppositely to the side of the door inner plate 37. However, it is also possible to arrange the cold air blowoff port 23 oppositely to the upper surface of the door inner plate 37.

Moreover, a case is shown above in which cold air is led from the cooler chamber 9 to the back cold-air supply duct 11, side cold-air communicating duct 38, and door cold-air supply duct 30 in order and introduced into the cold air blowoff port 31 of the refrigerator door. However, it is also possible to use the side cold-air supply duct 18 in FIG. 2 instead of the back cold-air supply duct 11. Further, the door shelf portion 32 is more completely cooled by setting the side temperature sensor 20 nearby the refrigerator door.

Figure 2:
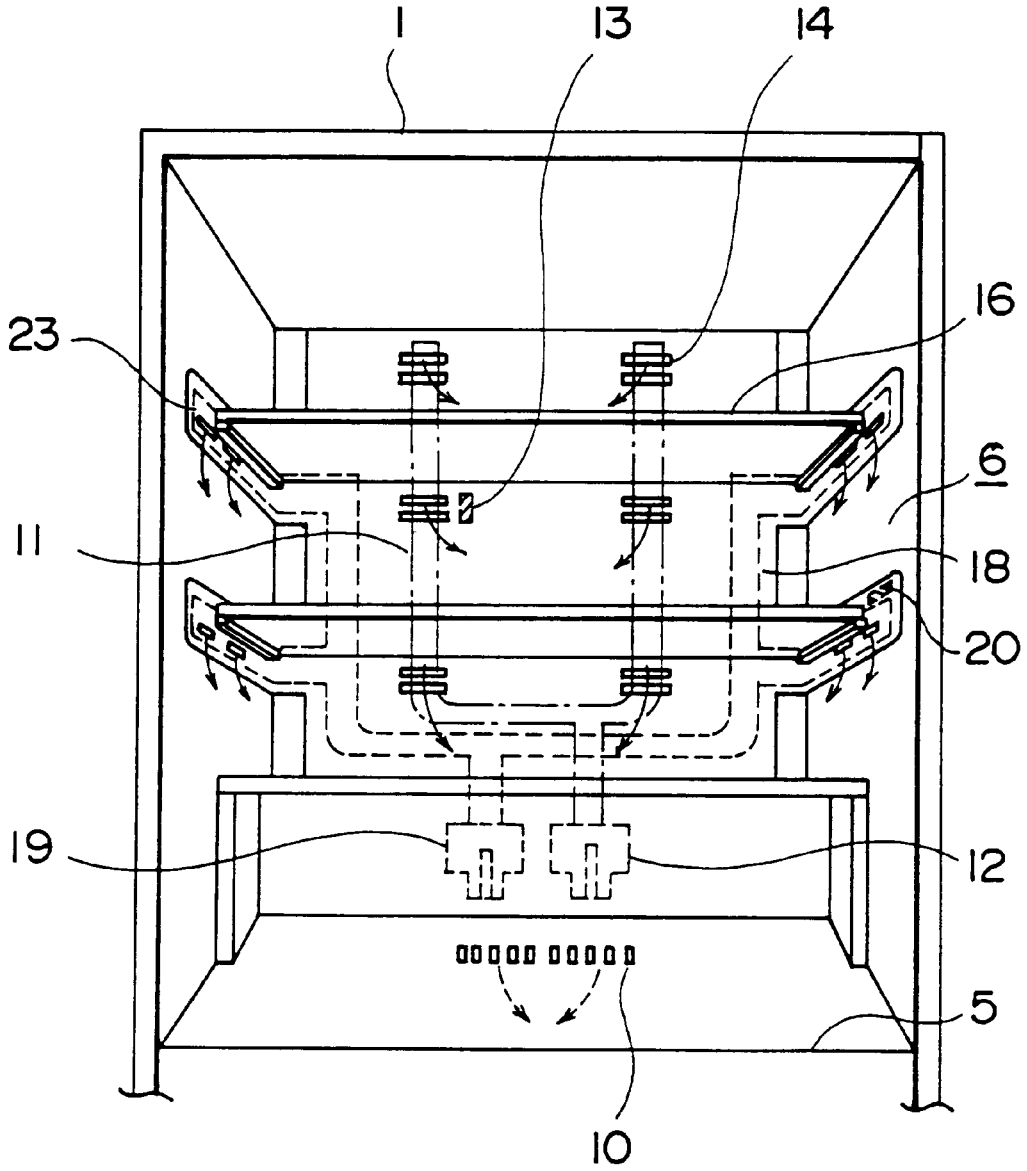
FIG. 2 is a perspective view of the inside of the refrigerator of the embodiment 1 of the present invention.

Furthermore, by extending the side cold-air supply duct 18 in FIG. 2 up to the vicinity of the refrigerator door, it is possible to supply cold air from the cooler chamber 9 to the door cold-air supply duct 30 through the side cold-air supply duct 18. Thus, the number of parts can be reduced because it is unnecessary to additionally use the side cold-air communicating duct 38.

Figure 11:
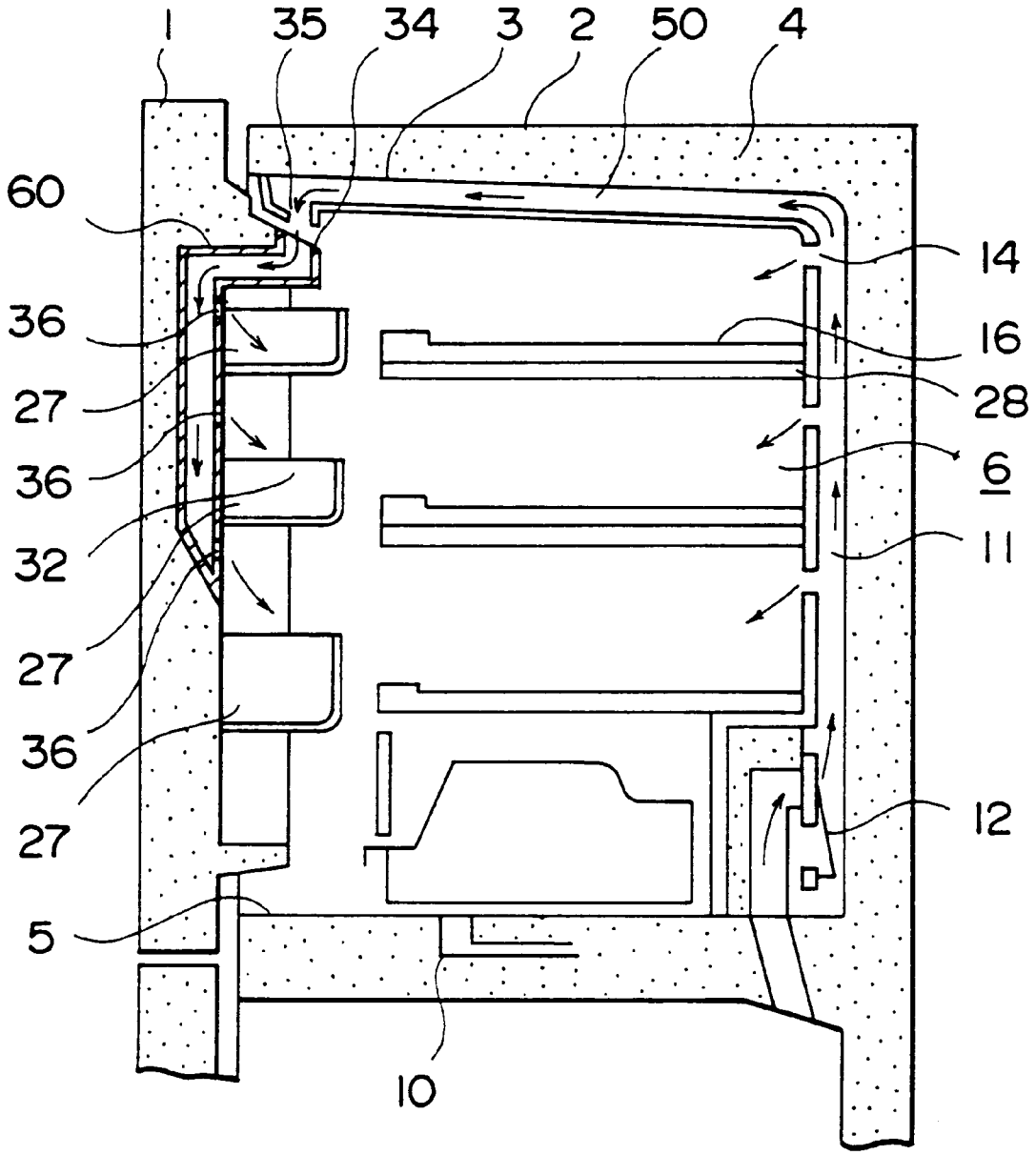
FIG. 11 is an enlarged sectional view of the refrigerator of the embodiment 1 of the present invention.
Figure 12:
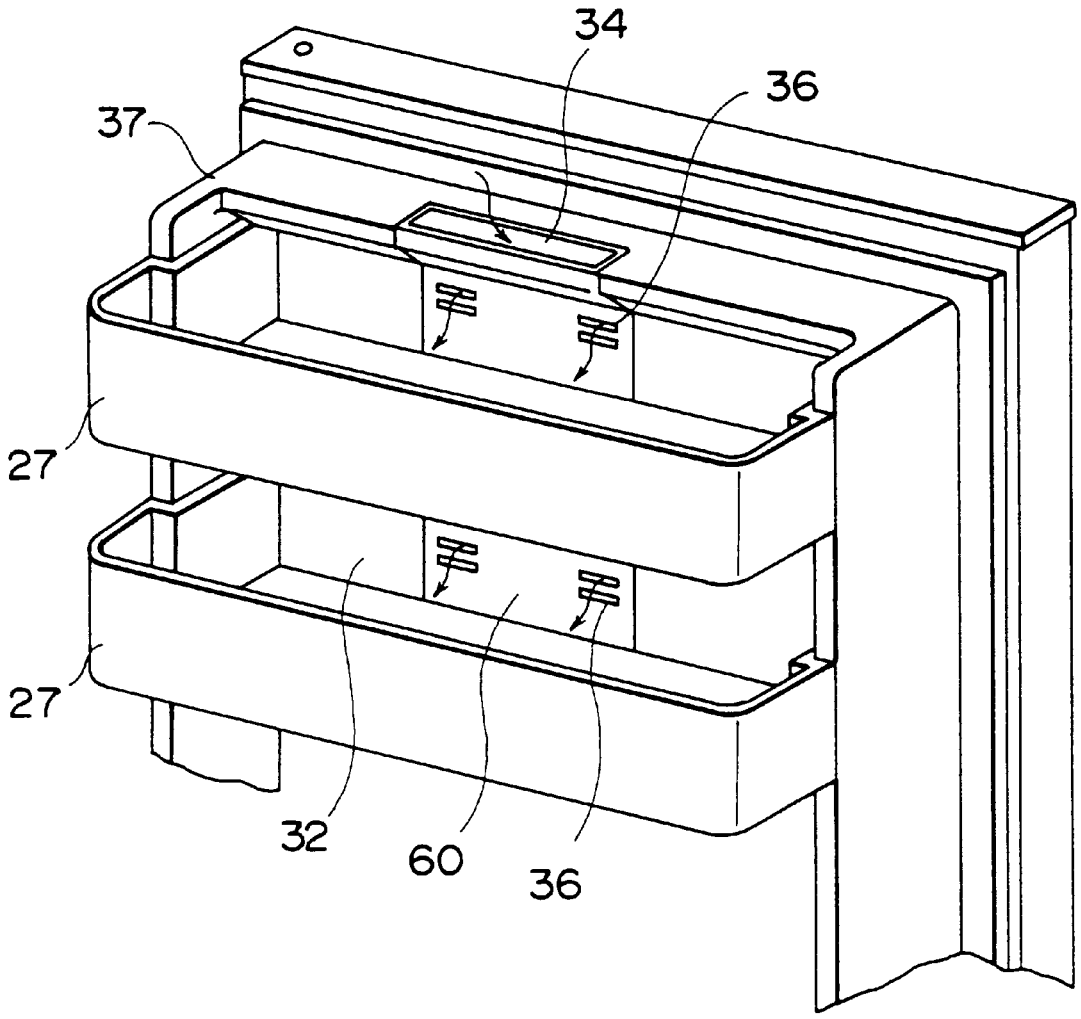
FIG. 12 is a perspective view of the inside of the refrigerator of the embodiment 1 of the present invention.
Figure 13:
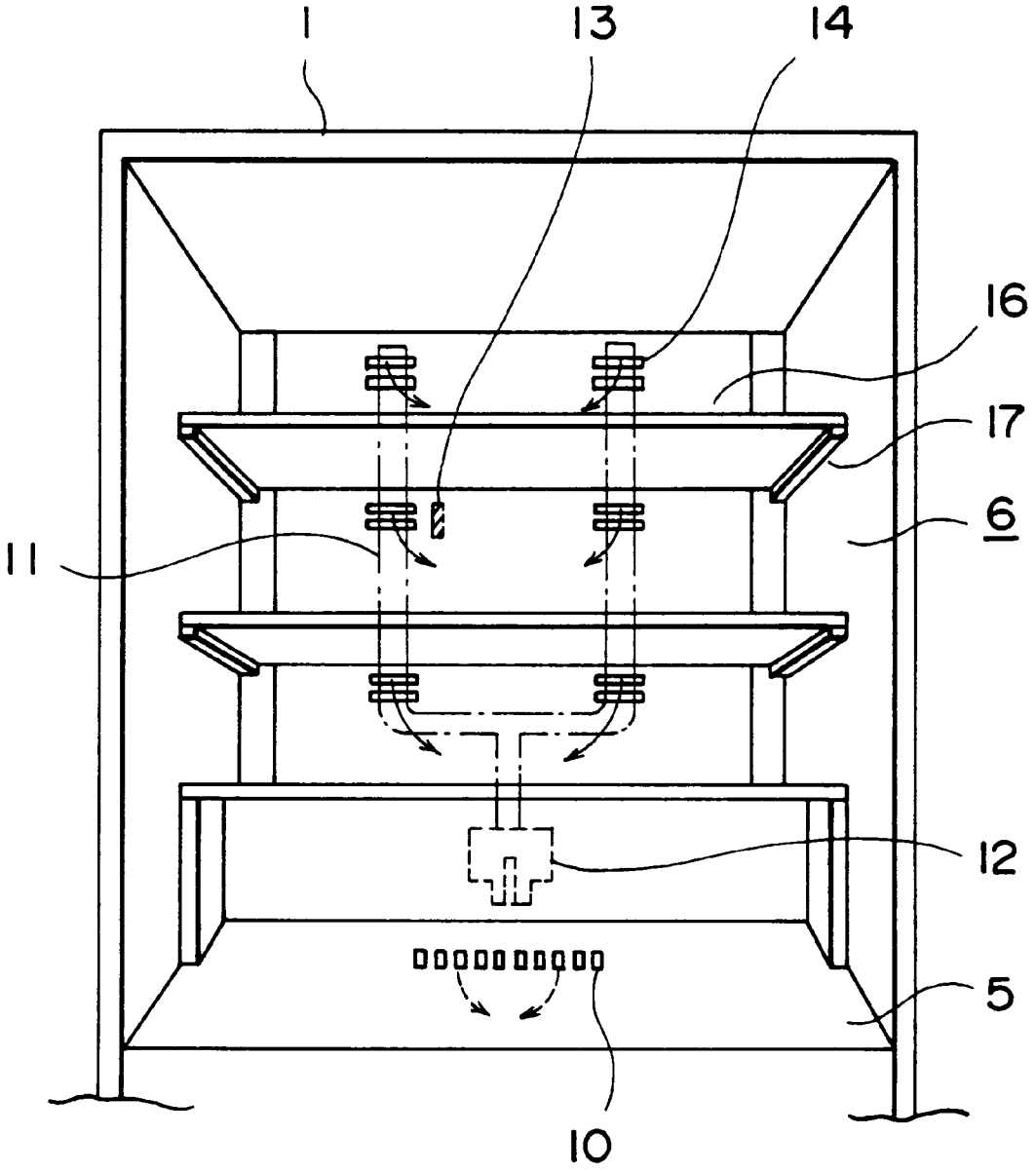
FIG. 13 is a perspective view of the inside of a conventional refrigerator.
Figure 14:
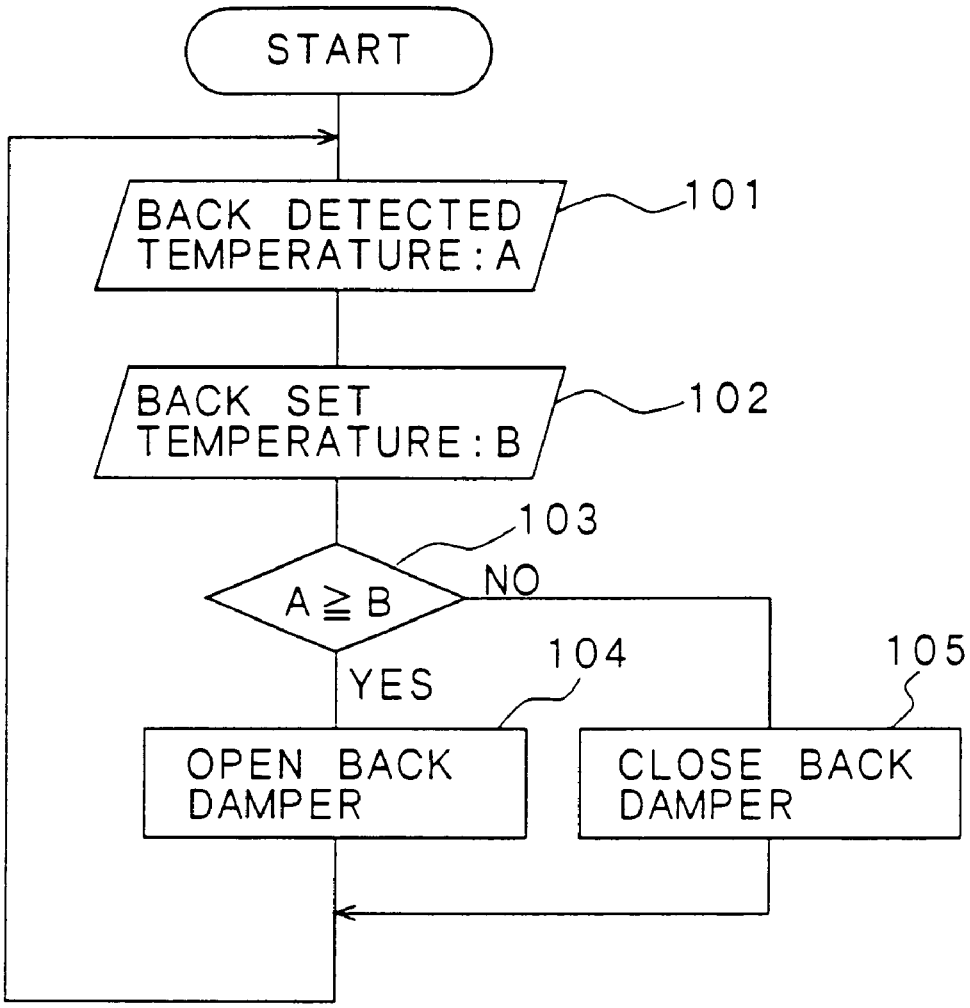
FIG. 14 is a flow chart for control of a conventional refrigerator.
Figure 15:
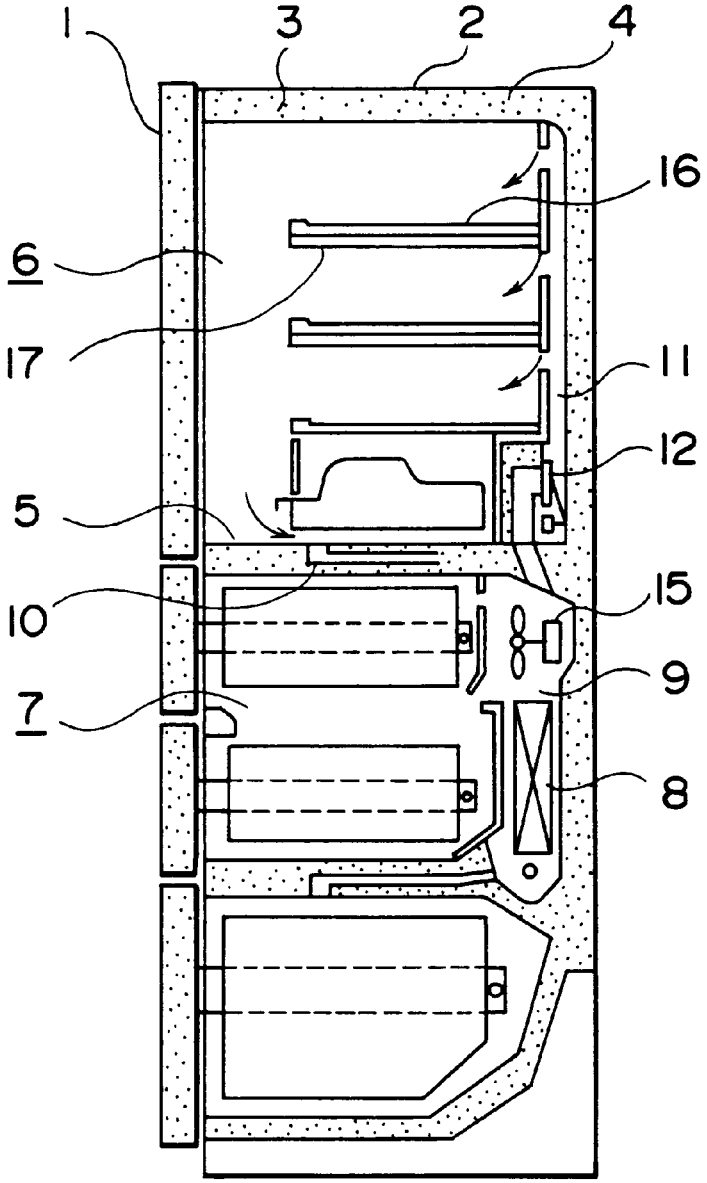
FIG. 15 is a sectional view of a conventional refrigerator.

In FIGS. 11 and 12, some of the cold air in the back cold-air supply duct 11 is led to the side of a refrigerator door 1 through a ceiling cold-air communicating duct 50 partitioning the ceiling of the refrigerating chamber 6 and enters a cold air intake 34 of a door cold-air supply duct 60 from a cold air blowoff port 35 of the ceiling cold-air communicating duct 50. The cold air entering the door cold-air supply duct 60 blows off from cold-air blowoff ports 36 at the back of the refrigerator door shelf portion 32 provided for the refrigerator-door inner plate 37 to each door shelf portion 32 serving as a storage space of the door pocket 27, so as to completely cool the food and the like in the storage space of the door pocket 27 from the back.

A case is described above in which cold air is led from the cooler chamber 9 to the back cold-air supply duct 11, ceiling cold-air communicating duct 50, and door cold-air supply duct 60 in order and then, led to the cold air blowoff ports 36 of a refrigerator door 1. However, it is also possible to use the side cold-air supply duct 18 in FIG. 2 instead of the back cold-air supply duct 11 and further, the door shelf portion 32 is more completely cooled by setting a side temperature sensor 20 nearby the refrigerator door.

Moreover, by using cold air blowoff ports 31 at the side of the refrigerator door in FIGS. 9 and 10 and the cold air blowoff ports 36 in FIGS. 11 and 12 together, all areas of the door shelf portion 32 can be completely cooled even if the door pocket 27 is transversely wide in the case of a large refrigerator.

Furthermore, the cold air blowoff ports 36 are arranged in the central portion of the door pocket 27 in the above case. However, by forming a duct over the transverse direction of the door pocket 27 and forming a plurality of cold air blowoff ports 36 on the duct, it is possible to completely cool the food and the like because cold air reaches up to the both sides of the door pocket 27 without forming the cold air blowoff port 31 at the side of the refrigerator door.

Figure 4:
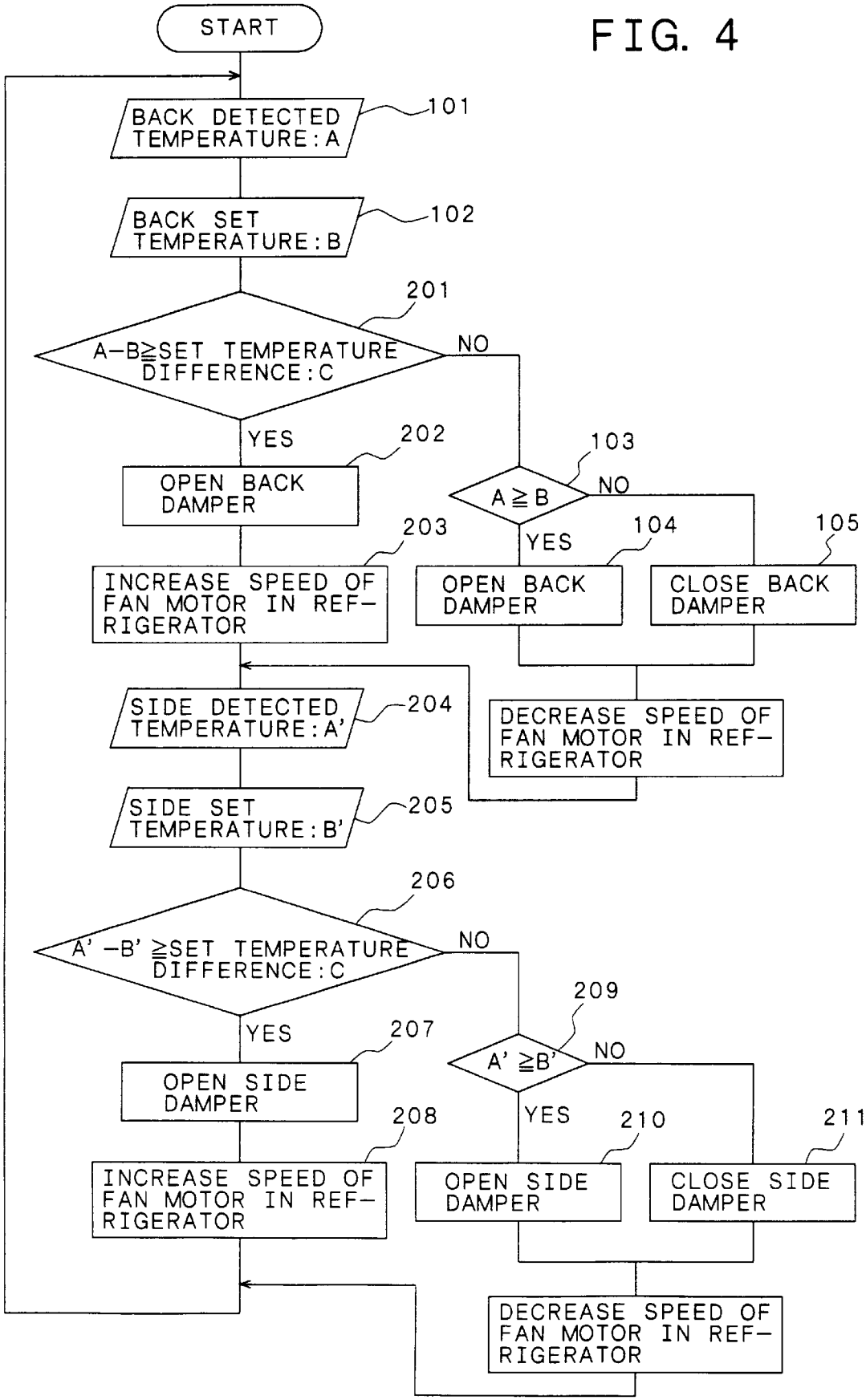
FIG. 4 is a flow chart for control of the refrigerator of the embodiment 1 of the present invention.

FIG. 4 is a flow chart showing a procedure for controlling the temperature in a refrigerating chamber. When the program starts, a back detected temperature A which is a value detected by the back temperature sensor 13 serving as back temperature detection means is inputted in step 101 and a back set temperature B of a refrigerating chamber is inputted in step 102 to compare the difference between the inputted back detected temperature A and back set temperature B with a set temperature difference C in step 201. When the difference between the back detected temperature A and the back set temperature B is equal to or larger than the set temperature difference C, the program goes to step 202 where the back damper is opened and then step 203 where the fan motor 15 in the refrigerator is operated at a high speed to introduce cold air into the refrigerating chamber 6. When the difference between the back detected temperature A and the back set temperature B is smaller than the set temperature difference C, the inputted back detected temperature A and back set temperature B are compared each other in step 103. When the back detected temperature A is equal to or higher than the back set temperature B, the program goes to step 104 where the back damper 12 is opened and proceeds to step 204. When the back detected temperature A is lower than the back set temperature B, the program goes to step 105 where the back damper 12 is closed and proceeds to step 204. A side detected temperature A' which is a value detected by the side temperature sensor 20 serving as side temperature detection means is inputted in step 204 and a side set temperature B' is inputted in step 205 to compare the difference between the inputted side detected temperature A' and side set temperature B' with the set temperature difference C in step 206. When the difference between the side detected temperature A' and the side set temperature B' is equal to or larger than the set temperature difference C, the program goes to step 207 where the side damper 19 is opened, and then to step 208 where the fan motor 15 in the refrigerator is operated at a high speed to introduce cold air into the refrigerating chamber 6. When the difference between the side detected temperature A' and side set temperature B' is smaller than the set temperature difference C, the inputted side detected temperature A' and side set temperature B' are compared each other in step 209. When the side detected temperature A' is equal to or higher than the side set temperature B', the program goes to step 201 where the side damper 19 is opened and returns to step 101. When the side detected temperature A' is lower than the side set temperature B', the program goes to step 211 where the side damper 19 is closed and returns to step 101.

Moreover, it is considered to supply cold air to the back cold-air blowoff ports 14 and the side cold-air blowoff ports 23 from the back cold-air supply duct 11 without using the side cold-air supply duct 18. In this case, it is considered to use either or both of the side temperature detection sensor 20 and the back temperature detection sensor 13. When using the both sensors, the temperature in the refrigerating chamber is more securely uniformed.

Embodiment 2

Figure 5:
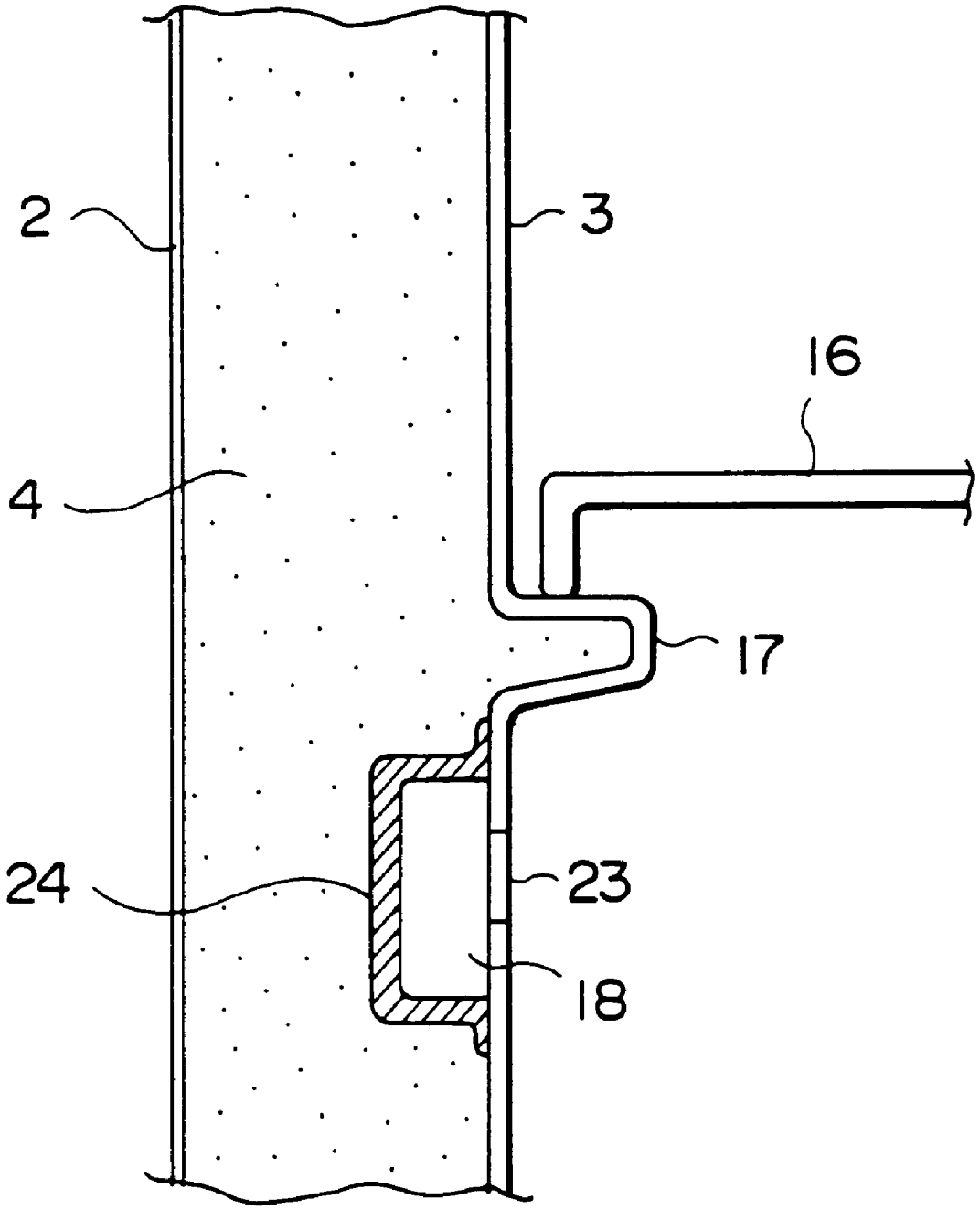
FIG. 5 is a sectional view of an essential portion of the refrigerator of embodiment 2 of the present invention.

The embodiment 2 of the present invention is described below by referring to an accompanying drawing. FIG. 5 is a sectional view of an essential portion of the refrigerator of the embodiment 2 of the present invention.

In the case of the embodiment 1, the side cold-air supply duct 18 is formed with the shelf support rail 21 and the recess 22 of the inner case 3. However, the same advantage as the case of the embodiment 1 is also obtained by embedding a cold air channel member 24 in a heat insulating material 4 and providing the inner case 3 with a side blowoff port 23 as shown in FIG. 5. Moreover, because the cold air channel member 24 is embedded in the heat insulating material 4, the side cold-air supply duct 18 is not visible from the inside of the refrigerator. Therefore, the design is preferable and cleaning can be easily made because nothing is protruded to the inside of the refrigerator.

Embodiment 3

Figure 6:
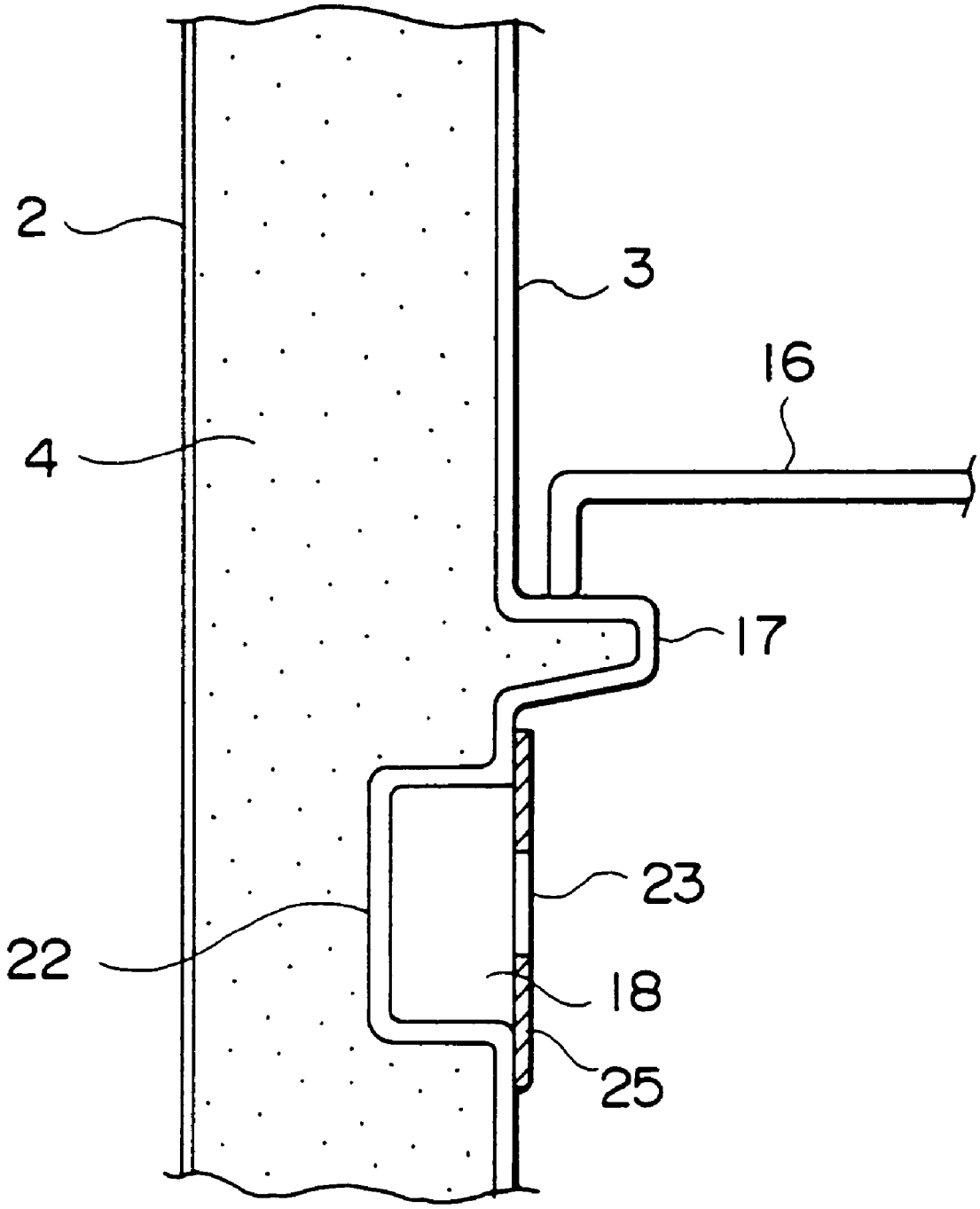
FIG. 6 is a sectional view of an essential portion of the refrigerator of embodiment 3 of the present invention.

The embodiment 3 of the present invention is described below by referring to an accompanying drawing. FIG. 6 is a sectional view of an essential portion of the refrigerator of the embodiment 3 of the present invention.

In the case of the embodiment 1, the side cold-air supply duct 18 is formed with the shelf support rail 21 and the recess 22 of the inner case 3. However, the same advantage as the case of the embodiment 1 is also obtained by securing a cold air channel member 25 to the recess 22 of the inner case 3 formed in the depth direction and providing the cold air channel member 25 with a side blowoff port 23 as shown in FIG. 6. Moreover, because the cold air channel member 25 constitutes only one side of the side cold air supply duct 18 facing the inside of the chamber, the used material and the cost can be reduced.

Embodiment 4

Figure 7:
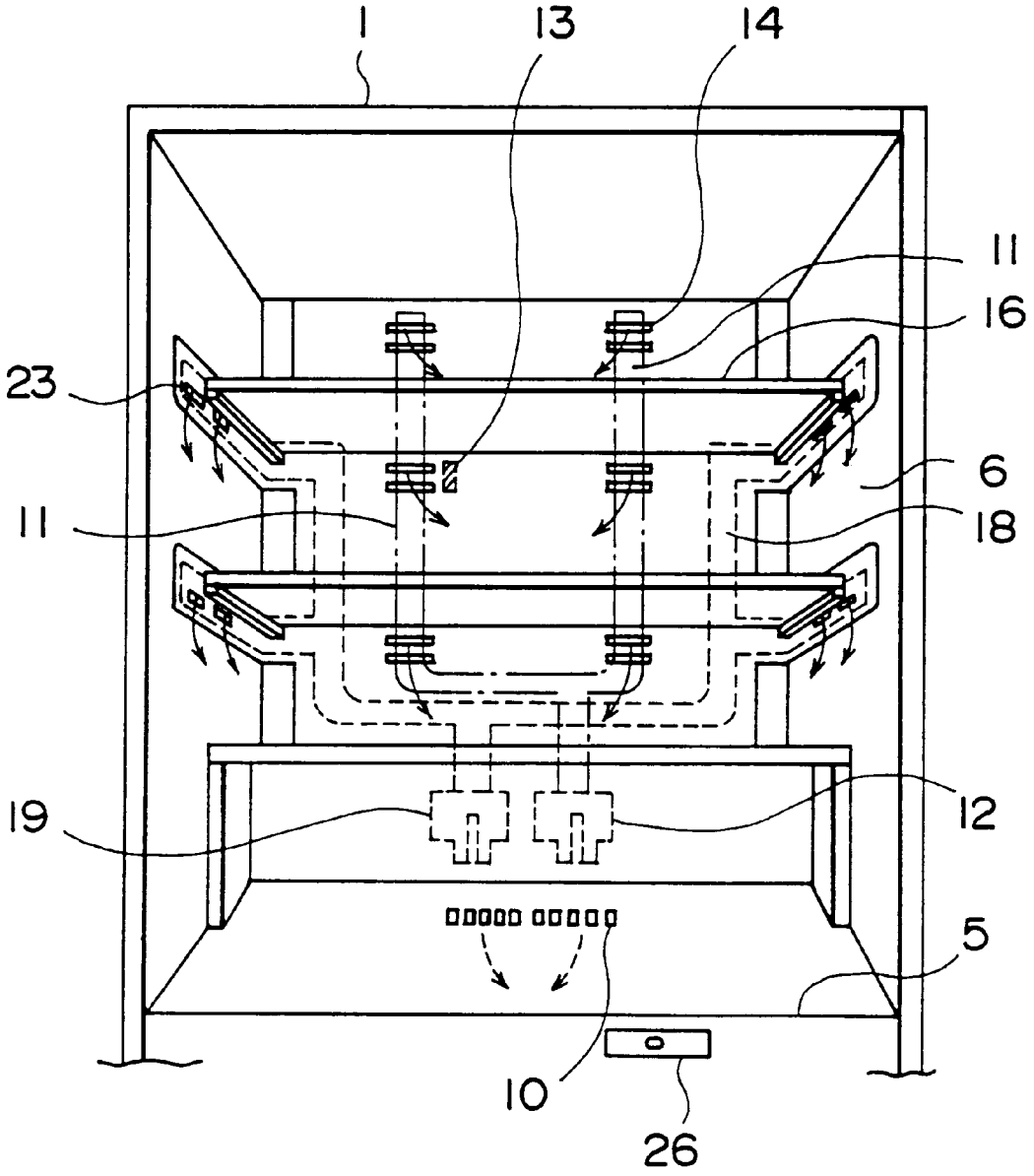
FIG. 7 is a perspective view of the inside of the refrigerator of embodiment 4 of the present invention.

The embodiment 4 of the present invention is described below by referring to an accompanying drawing. FIG. 7 is a perspective view of the inside of the refrigerator of the embodiment 4 of the present invention.

In the case of the embodiment 1, the operation of the side damper 19 is controlled in accordance with the temperature detected by the side temperature sensor 20. However, the same advantage as the case of the embodiment 1 is also obtained by controlling the operation of the damper 19 in accordance with the opening and closing operation of the door detected by door operation detection means 26 such as a door switch of a refrigerating chamber.

Though side cold-air blowoff ports 23*a,* 23*b,* and 23*c* are used as the side cold-air blowoff ports 23, it is possible to use only one blowoff port.

We claim:

1. A refrigerator comprising:

a cold air supply duct for supplying cold air from a cooler chamber in which a cooling unit is set to cold air blowoff ports at the back and side of a refrigerating chamber;

a back damper for opening or closing an intake port for supplying cold air to said cold air blowoff ports at the back of the refrigerating chamber via said cold air supply duct;

a side damper for opening or closing an intake port for supplying cold air to said cold air blowoff ports at the side of the refrigerating chamber via said cold air supply duct;

a temperature detector for detecting the temperature of a refrigerating chamber; and a control unit for controlling the operation of said back damper and said side damper in accordance with the temperature detected by said temperature detector;

wherein at least one of the cold air blowoff ports at the side of said refrigerating chamber is located near the door of said refrigerator.

2. The refrigerator according to claim 1, wherein said cold air supply duct has a back cold-air supply duct for supplying cold air to the cold air blowoff ports at the back of said refrigerating chamber and a side cold-air supply duct for supplying cold air to the cold air blowoff ports at the side of said refrigerating chamber and said side cold-air supply duct is embedded in a heat insulating material.

3. The refrigerator according to claim 1, wherein said cold air supply duct has a back cold-air supply duct for supplying cold air to the cold air blowoff ports at the back of said refrigerating chamber and a side cold-air supply duct for supplying cold air to the cold air blowoff ports at the side of said refrigerating chamber and said side cold-air supply duct is integrally formed to the inner case of said refrigerating chamber.

4. A refrigerator comprising:

a cold air supply duct for supplying cold air from a cooler chamber in which a cooling unit is set to cold air blowoff ports at the back and side of a refrigerating chamber;

a damper for opening or closing an intake port for taking cold air into said cold air supply duct;

a temperature detector for detecting the temperature of a refrigerating chamber; and a control unit for controlling the operation of said damper in accordance with the temperature detected by said temperature detector;

wherein at least one of the cold air blowoff ports at the side of said refrigerating chamber is located nearby the door of said refrigerator, said cold air supply duct has a back cold-air supply duct for supplying cold air to the cold air blowoff ports at the back of said refrigerating chamber and a side cold-air supply duct for supplying cold air to the cold air blowoff ports at the side of said refrigerating chamber, and said side cold-air supply duct is formed with both a shelf support rail protruded inside of said refrigerating chamber for mounting a shelf to partition said refrigerating chamber and a part of the inner case of said refrigerating chamber.

5. A refrigerator comprising:

a back cold-air supply duct for supplying cold air from a cooler chamber in which a cooling unit is set to cold air blowoff ports at the back of a refrigerating chamber;

a side cold-air supply duct for supplying cold air to cold air blowoff ports at the side of said refrigerating chamber;

a back damper for opening or closing an intake port for taking cold air into said back cold-air supply duct; and a side damper for opening or closing an intake port for taking cold air into said side cold-air supply duct.

6. The refrigerator according to claim 5, further comprising:

back temperature detection means for detecting the temperature of the back of said refrigerating chamber;

side temperature detection means for detecting the temperature of the side of said refrigerating chamber; and control means for controlling the operations of said dampers in accordance with the both or either of the values detected by said detection means.

7. The refrigerator according to claim 5, further comprising:

back temperature detection means for detecting the temperature of the back of said refrigerating chamber;

door operation detection means for detecting the opening and closing operation of a door of said refrigerating chamber; and control means for controlling the operations of said dampers in accordance with both or either of the values detected by said detection means.

8. The refrigerator according to claim 5, wherein said side cold-air supply duct is embedded in a heat insulating material.

9. The refrigerator according to claim 5, wherein said side cold-air supply duct is integrally formed to the inner case of a refrigerating chamber.

10. The refrigerator according to claim 5, wherein said side cold-air supply duct is formed with both a shelf support rail protruded inside of a refrigerating chamber for mounting a shelf to partition said refrigerating chamber and a part of the inner case of said refrigerating chamber.

11. The refrigerator according to claim 5, wherein the amount of cold air of a cold air supply duct for supplying cold air to blowoff ports at the side of said refrigerating chamber is controlled by controlling the operation of said side damper after opening and closing the door of said refrigerating chamber.

12. The refrigerator according to claim 6, wherein the number of revolutions of a fan motor in said refrigerator is controlled in accordance with both or either of values detected by said back temperature detection means and said side temperature detection means.

13. The refrigerator according to claim 5, further comprising:

a cold air communicating duct provided for the ceiling of said refrigerating chamber for communicating cold air from said back cold-air supply duct to the door side of said refrigerating chamber; and a door cold-air supply duct having door blowoff ports, provided in a door of said refrigerating chamber, for supplying cold air from said cold air communicating duct to said door blowoff ports to blow a storage space in a door shelf portion attached to said door of the refrigerating chamber.

14. The refrigerator according to claim 5, further comprising:

a cold air communicating duct provided for the side of said refrigerating chamber for communicating cold air from said back cold-air supply duct to the door side of said refrigerating chamber; and a door cold-air supply duct having door blowoff ports, provided in a door of said refrigerating chamber, for supplying cold air from said cold air communicating duct to said door blowoff ports to blow a storage space in a door shelf portion attached to said door of the refrigerating chamber.

15. The refrigerator according to claim 5, further comprising:

a cold air communicating duct provided for the ceiling of said refrigerating chamber for communicating cold air from said side cold-air supply duct to the door side of said refrigerating chamber; and a door cold-air supply duct having door blowoff ports, provided in a door of said refrigerating chamber, for supplying cold air from said cold air communicating duct to said door blowoff ports to blow a storage space in a door shelf portion attached to said door of the refrigerating chamber.

16. The refrigerator according to claim 5, further comprising:

a cold air communicating duct provided for the side of said refrigerating chamber for communicating cold air from said side cold-air supply duct to the door side of said refrigerating chamber; and a door cold-air supply duct having door blowoff ports, provided in a door of said refrigerating chamber, for supplying cold air from said cold air communicating duct to said door blowoff ports to blow a storage space in a door shelf portion attached to said door of the refrigerating chamber.

* * * * *